US010823205B2

(12) United States Patent
Wang et al.

(10) Patent No.: US 10,823,205 B2
(45) Date of Patent: Nov. 3, 2020

(54) NOZZLE DEVICE

(71) Applicant: Team Worldwide Corporation, Taipei (TW)

(72) Inventors: Cheng-Chung Wang, Taipei (TW); Chien-Hua Wang, Taipei (TW)

(73) Assignee: TEAM WORLDWIDE CORPORATION, Taipei (TW)

( * ) Notice: Subject to any disclaimer, the term of this patent is extended or adjusted under 35 U.S.C. 154(b) by 54 days.

(21) Appl. No.: 15/469,398

(22) Filed: Mar. 24, 2017

(65) Prior Publication Data

US 2017/0274396 A1 Sep. 28, 2017

Related U.S. Application Data

(60) Provisional application No. 62/313,551, filed on Mar. 25, 2016.

(51) Int. Cl.

| | |
|---|---|
| ***B05B 1/30*** | (2006.01) |
| ***F04F 5/46*** | (2006.01) |
| ***B05B 7/12*** | (2006.01) |
| ***B05B 1/00*** | (2006.01) |

(52) U.S. Cl.

CPC ..... *F04F 5/46* (2013.01); *B05B 1/005* (2013.01); *B05B 1/3006* (2013.01); *B05B 7/12* (2013.01)

(58) Field of Classification Search

CPC ..... B01F 3/02; B01F 2215/0422; B01F 2215/0427; B01F 2215/0431; F04F 5/46; F04F 5/16; F04F 5/20; B05B 1/005; B05B 7/12; B05B 7/1254; B05B 1/30; B05B 1/3006; B05B 1/3013; B05B 1/3026

USPC .... 137/895, 223–226; 141/10, 38, 114, 313; 417/182, 190, 191

See application file for complete search history.

(56) References Cited

U.S. PATENT DOCUMENTS

| | | | | |
|---|---|---|---|---|
| RE27,860 E * | 1/1974 | Day | B64D 25/14 | 417/184 |
| 4,166,477 A * | 9/1979 | Duthion | F15D 1/08 | 126/307 R |
| 4,368,009 A * | 1/1983 | Heimovics, Jr. | B61B 12/005 | 417/179 |
| 8,511,340 B2 * | 8/2013 | Smid | F02M 37/025 | 137/565.22 |

FOREIGN PATENT DOCUMENTS

| | | |
|---|---|---|
| EP | 2574796 A1 | 4/2013 |
| JP | 2016-502027 | 1/2016 |

* cited by examiner

*Primary Examiner* — Jason J Boeckmann

(57) ABSTRACT

A nozzle device includes a first passage, a second passage, and a first ambient valve clapper. The first passage includes a first intake and a first outlet. The second passage includes a second intake and a second outlet. The first ambient valve clapper is configured to control entry of fluid into the second passage through the second intake. The fluid is pumped to enter the first passage through the first intake to form a first negative pressure zone next to the first outlet, and the first ambient valve clapper is opened via a pressure difference between the first negative pressure zone and the surrounding of the nozzle device, allowing the fluid to flow into the second passage.

18 Claims, 11 Drawing Sheets

NOZZLE DEVICE

CROSS REFERENCE TO RELATED APPLICATIONS

This application claims the benefit of U.S. Provisional Application No. 62/313,551, filed Mar. 25, 2016, the entirety of which is hereby incorporated by reference.

BACKGROUND OF THE INVENTION

Field of the Invention

The present invention relates to a nozzle device, and more particularly to a nozzle device capable of increasing pumping efficiency and shortening pumping time.

Description of the Related Art

An inflatable product is inflated by an air pump or other pumping devices before use. However, inflation takes a long time when the inflatable product (e.g. an air mattress) is large in size.

BRIEF SUMMARY OF THE INVENTION

The present invention provides a nozzle device. When a pumping device is connected to a chamber (e.g. an inflatable product) through the nozzle device, the nozzle device is able to introduce more fluid (e.g. air) into the chamber, thereby increasing pumping efficiency and shortening pumping time.

The nozzle device in accordance with an exemplary embodiment of the invention includes a first passage, a second passage, and a first ambient valve clapper. The first passage includes a first intake and a first outlet. The second passage includes a second intake and a second outlet. The first ambient valve clapper is configured to control entry of fluid into the second passage through the second intake. The fluid flows through the first intake into the first passage to form a first fluid flow when the fluid is pumped, a first negative pressure zone is formed outside the first passage and next to the first outlet, and the first ambient valve clapper is opened via a pressure difference between the first negative pressure zone and a surrounding of the nozzle device, allowing the fluid to further flow into the second passage to form a second fluid flow.

In another exemplary embodiment, the first passage is disposed in the second passage.

In yet another exemplary embodiment, the first outlet has a smaller cross-sectional area than the first intake to increase a velocity of the first fluid flow at the first outlet and form the first negative pressure zone.

In another exemplary embodiment, the second passage further includes a mixing zone next to the first negative pressure zone, and the first fluid flow exiting from the first passage is mixed with the second fluid flow in the mixing zone.

In yet another exemplary embodiment, the nozzle device satisfies the following condition:

$$\frac{S_e}{S_c} = \left(\frac{\phi_e}{\phi_c}\right)^2 = \left[\frac{1+U_0}{\sqrt{\frac{\tau^2}{2-\tau^2}}} \cdot \sqrt{\frac{\Delta q}{\Delta p}}\right]$$

where $S_e$ is a cross-sectional area of the mixing zone, $S_c$ is a cross-sectional area of the first outlet, $\phi_e$ is a diameter of the mixing zone, $\phi_c$ is a diameter of the first outlet, $U_0$ is a volume injection coefficient, $\tau$ is a coefficient of diffusion velocity, $\Delta q$ is a difference between a pumping pressure for the fluid to enter the first passage and a pressure in the first negative pressure zone, and $\Delta p$ is a pressure difference between the surrounding of the nozzle device and the first negative pressure zone;

wherein the above volume injection coefficient is calculated by $$U_0 = \frac{V_m}{V_p} = K \cdot \sqrt{\frac{\Delta q}{\Delta p}} - 1,$$

where $V_m$ is the volume flow rate of the fluid pumped into the first passage, $V_p$ is the volume flow rate of the fluid entering the second passage, and K is a coefficient ranging from 0 to 1.

In yet another exemplary embodiment, $0.5<\tau<1$.

In another exemplary embodiment, the mixing zone has a length b, and $6\phi_c \le b \le \phi_c$ where $\phi_c$ is a diameter of the first outlet of the first passage.

In yet another exemplary embodiment, the second passage further includes a diffusing zone next to the mixing zone, and the diffusing zone has a greater cross-sectional area than the mixing zone so that the mixed first fluid flow and second fluid flow spread in the diffusing zone.

In another exemplary embodiment, the diffusing zone is tapered.

In yet another exemplary embodiment, the diffusing zone has a length h, and $2(\phi_m-\phi_c) \le h \le 4(\phi_m-\phi_c)$ where $\phi_m$ is a diameter of the first intake of the first passage and $\phi_c$ is a diameter of the first outlet of the first passage.

In another exemplary embodiment, the second outlet of the second passage has a divergent angle k, and $5° \le k \le 12°$.

In yet another exemplary embodiment, the nozzle device further includes a third passage and a second ambient valve clapper. The third passage includes a third intake and a third outlet. The second ambient valve clapper is configured to control entry of the fluid into the third passage through the third intake to form a third fluid flow. The second negative pressure zone is formed outside the second passage and next to the second outlet, and the second ambient valve clapper is opened via a pressure difference between the second negative pressure zone and the surrounding of the nozzle device, allowing the fluid to further flow into the third passage to form the third fluid flow.

In another exemplary embodiment, the first passage is disposed in the second passage, and the second passage is disposed in the third passage.

In yet another exemplary embodiment, the third passage further includes a mixing zone next to the second negative pressure zone, and the first and second fluid flows exiting from the second passage are mixed with the third fluid flow in the mixing zone.

In another exemplary embodiment, the third passage further includes a diffusing zone next to the mixing zone, and the diffusing zone has a greater cross-sectional area than the mixing zone so that the mixed first, second, and third fluid flows spread in the diffusing zone.

In yet another exemplary embodiment, the first outlet is a converging outlet, while the second outlet and the third outlet are diverging outlets.

In another exemplary embodiment, the nozzle device further includes a fourth passage and a third ambient valve clapper. The fourth passage includes a fourth intake and a fourth outlet. The third ambient valve clapper is configured to control entry of the fluid into the fourth passage through the fourth intake to form a fourth fluid flow. A third negative pressure zone is formed outside the third passage and next to the third outlet, and the third ambient valve clapper is opened via a pressure difference between the third negative pressure zone and the surrounding of the nozzle device, allowing the fluid to further flow into the fourth passage to form the fourth fluid flow.

In yet another exemplary embodiment, the first outlet and the second outlet are converging outlets, while the third outlet and the fourth outlet are diverging outlets.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1A:
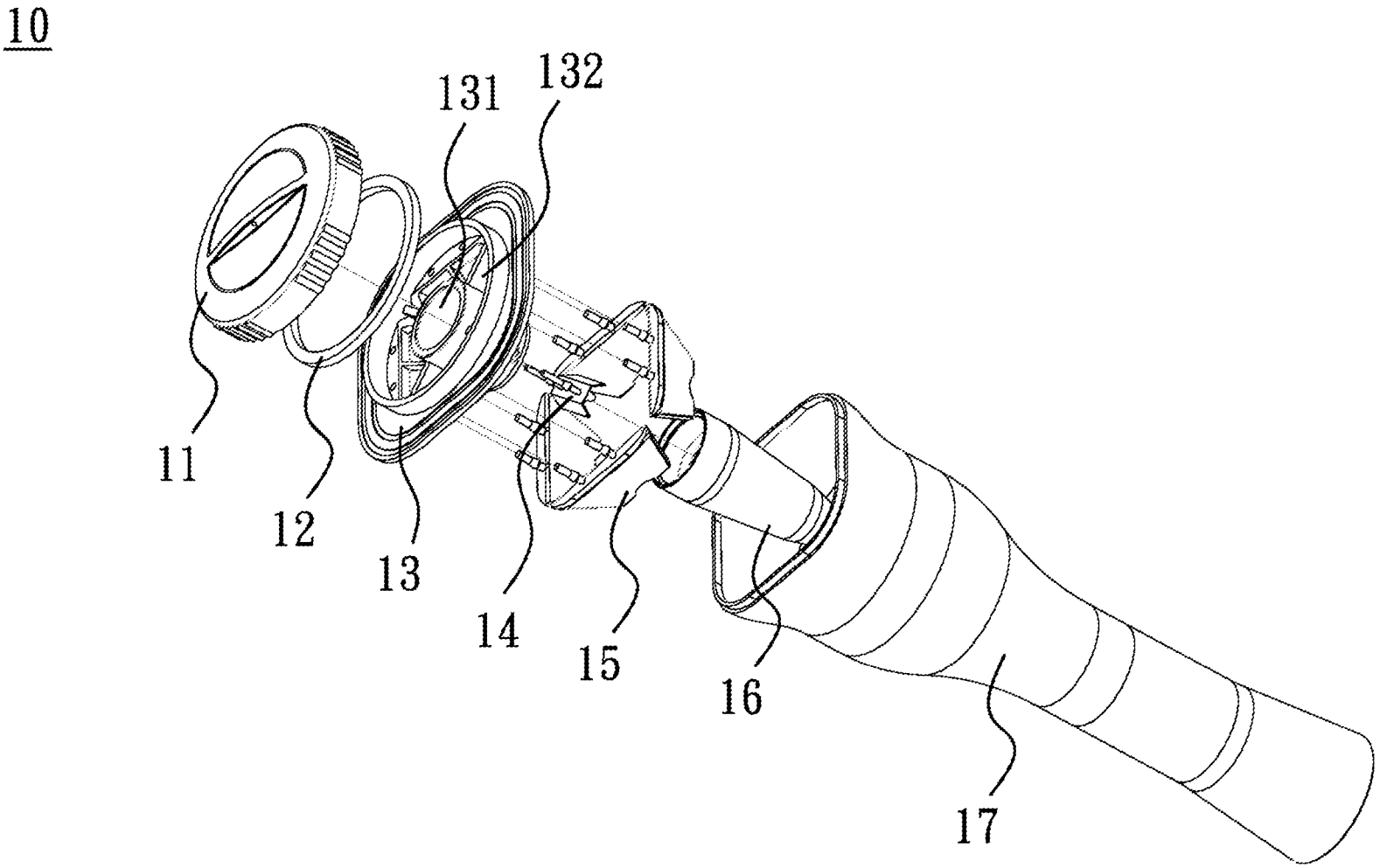
FIG. 1A is an exploded perspective diagram of a nozzle device in accordance with a first embodiment of the invention.
Figure 1B:
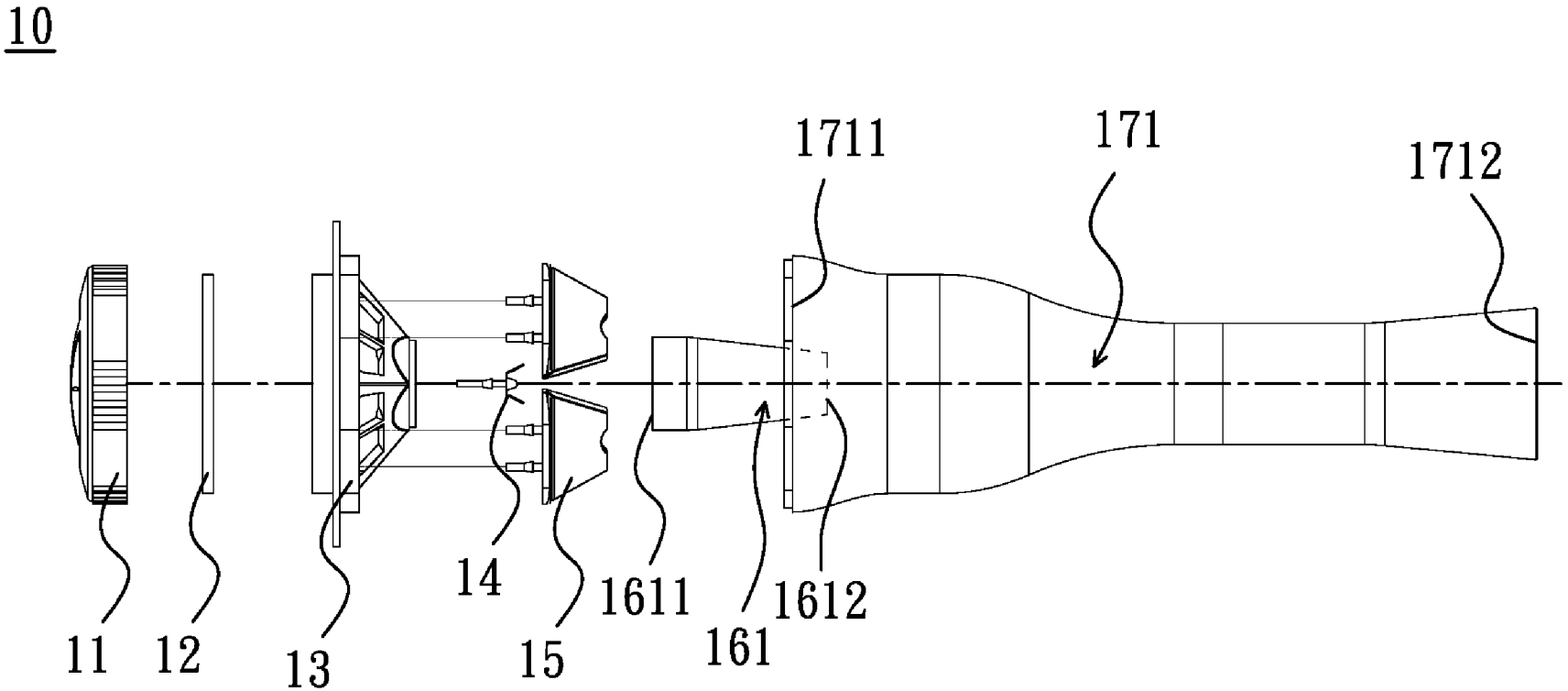
FIG. 1B is a front view of FIG. 1A.
Figure 2:
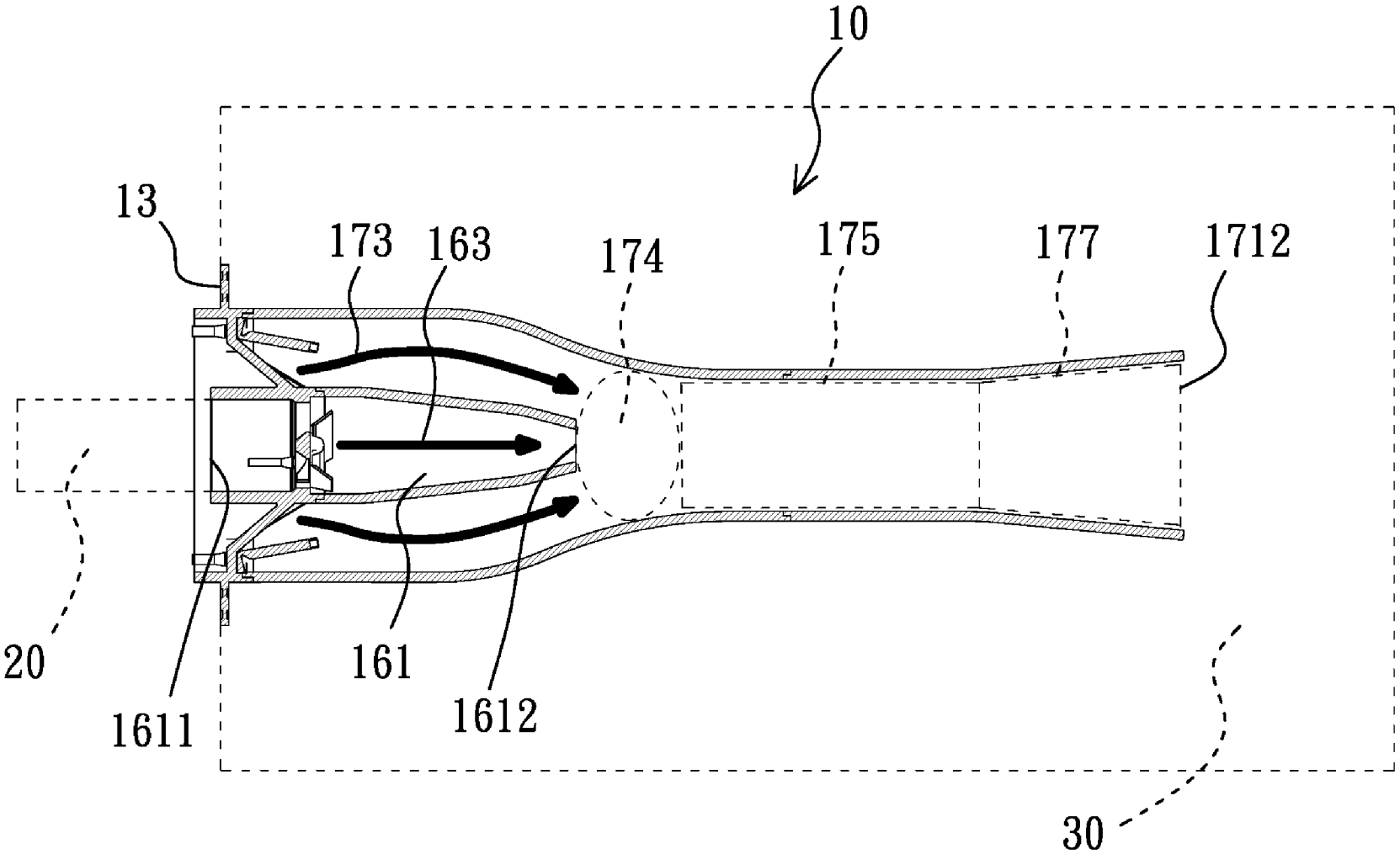
FIG. 2 is a sectional view of the nozzle device in accordance with the first embodiment of the invention.

Referring to FIGS. 1A, 1B and 2, a nozzle device 10 in accordance with a first embodiment of the invention includes a cover 11, an O-ring 12, a seat 13, at least one inflation valve clapper 14, at least one first ambient valve clapper 15, a first tubular body 16, and a second tubular body 17. The first tubular body 16 is disposed in the second tubular body 17. The first tubular body 16 defines a first passage 161 having a first intake 1611 and a first outlet 1612. The second tubular body 17 defines a second passage 171 having a second intake 1711 and a second outlet 1712. The first tubular body 16 and the second tubular body 17 are connected to the seat 13. The seat 13 has openings 131 and 132 respectively connecting to the first intake 1611 and the second intake 1711. The inflation valve clapper 14 and the first ambient valve clapper 15 are respectively disposed in the openings 131 and 132 of the seat 13 for controlling entry of outside air into the first passage 161 and the second passage 171.

Referring to FIG. 2, the second outlet 1712 of the nozzle device 10 is inside an inflatable product 30 and the seat 13 of the nozzle device 10 is connected to the inflatable product 30. The inflatable product 30 can be inflated by an air pump 20 (e.g. an electric pump or a manual pump) through the nozzle device 10. To do so, the air pump 20 is connected to the opening 131 of the seat 13 of the nozzle device 10. Outside air is pumped to open the inflation valve clapper 14 in the opening 131 and enters the first passage 161 to form a first fluid flow 163. It is noted that the cross-sectional area of the first passage 161 is gradually reduced so that the first outlet 1612 has a smaller cross-sectional area than the first intake 1611. This arrangement is to increase a velocity of the first fluid flow 163 in the first passage 161 and form a first negative pressure zone 174 next to the first outlet 1612. The pressure in the first negative pressure zone 174 is gradually reduced because the velocity of the first fluid flow 163 gradually increases. When a first pressure of the first negative pressure zone 174 is reduced to a first predetermined value, the first ambient valve clapper 15 is opened via a pressure difference between the outside atmosphere and the first negative pressure zone 174, allowing outside air to flow into the second passage 171 through the second intake 1711 and forming a second fluid flow 173. The second passage 171 has a mixing zone 175 next to the first negative pressure zone 174, and the first fluid flow 163 exiting from the first passage 161 is mixed with the second fluid flow 173 in the mixing zone 175. The second passage 171 further has a diffusing zone 177 next to the mixing zone 175. In this embodiment, the diffusing zone 177 is tapered with increasing cross-sectional area from the mixing zone 175 to the second outlet 1712 so that the mixed first fluid flow 163 and second fluid flow 173 can spread in the diffusing zone 177 to avoid undue aerodynamic drag and energy loss before entering the inflatable product 30.

This embodiment of the invention provides a second passage 171 which is able to introduce additional air into the inflatable product 30. Therefore, inflation by using the nozzle device 10 is faster and more efficient.

Referring to FIG. 1, the O-ring 12 is disposed on the seat 13. When the inflation is finished, the cover 11 can be placed to cover the seat 13, with the O-ring 12 compressed between the cover 11 and the seat 13 to generate a tight seal.

Figure 3:
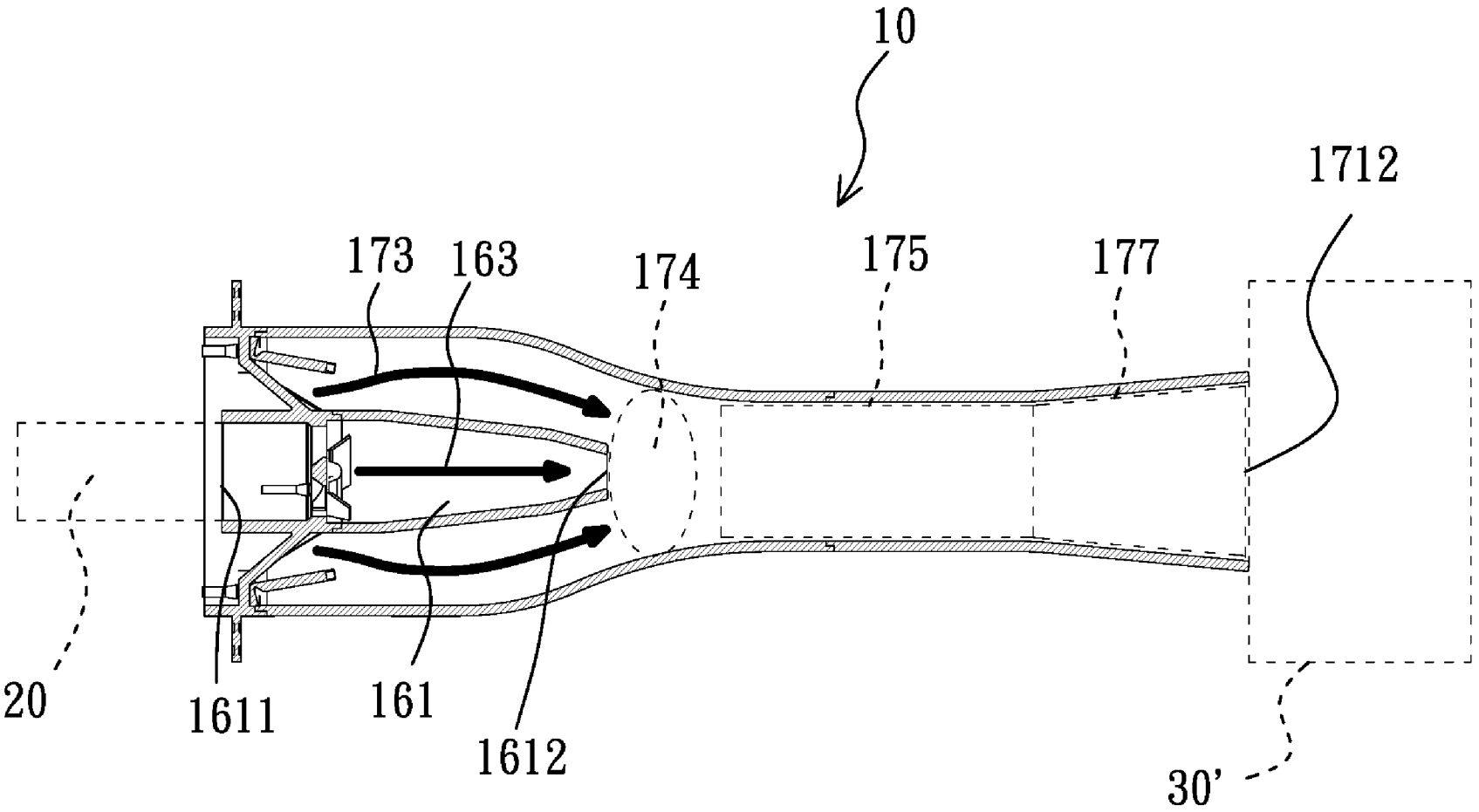
FIG. 3 depicts the nozzle device of the first embodiment connected to an inflatable product in a manner which is different from that of FIG. 2.

It is noted that the nozzle device 10 of the first embodiment can be connected to the inflatable product 30 in a manner which is different from that of FIG. 2. As shown in FIG. 3, for example, the nozzle device 10 is disposed outside an inflatable product 30', and the second outlet 1712 of the second passage 171 of the nozzle device 10 is connected to the inflatable product 30'.

Figure 4:
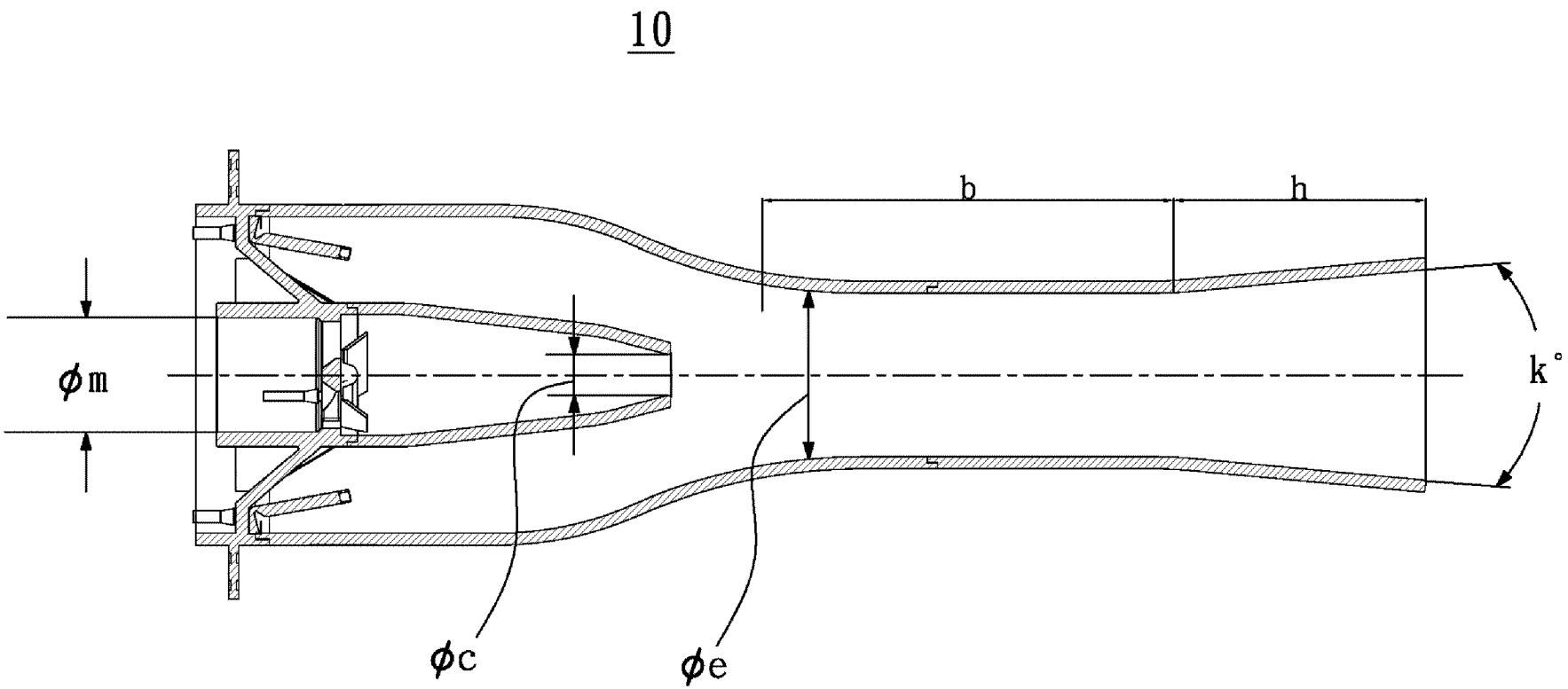
FIG. 4 is a sectional view of the nozzle device with dimensional parameters in accordance with the first embodiment of the invention.

Referring to FIG. 4, preferred dimensions of the nozzle device 10 in this embodiment are described as follows:

the nozzle device 10 satisfies $$\frac{S_e}{S_c} = \left(\frac{\phi_e}{\phi_c}\right)^2 = \left[\frac{1+U_0}{\sqrt{\frac{\tau^2}{2-\tau^2}}} \cdot \sqrt{\frac{\Delta q}{\Delta p}}\right]$$

where $S_e$ is a cross-sectional area of the mixing zone 175, $S_c$ is a cross-sectional area of the first outlet 1612, $\phi_e$ is a diameter of the mixing zone 175, $\phi_c$ is a diameter of the first outlet 1612, $U_0$ is a volume injection coefficient, $\tau$ is a coefficient of diffusion velocity, $\Delta q$ is a difference between a pumping pressure for the air pump 20 to pump outside air into the first passage 161 and a pressure in the first negative pressure zone 174, and $\Delta p$ is a pressure difference between the surrounding of the nozzle device 10 (the atmosphere) and the first negative pressure zone 174;

the above volume injection coefficient is calculated by $$U_0 = \frac{V_m}{V_p} = K \cdot \sqrt{\frac{\Delta q}{\Delta p}} - 1,$$

where $V_m$ is the volume flow rate of air pumped into the first passage 161 by the air pump 20, $V_p$ is the volume flow rate of air drawn into the second passage 171, and K is a coefficient ranging from 0 to 1;

the above coefficient of diffusion velocity satisfies $0.5<\tau<1$;

the mixing zone 175 has a length b, and $6\phi_c \le b \le 10\phi_c$ where $\phi_c$ is a diameter of the first outlet 1612 of the first passage 161;

the diffusing zone 177 has a length h, and $2(\phi_m-\phi_c) \le h \le 4(\phi_m-\phi_c)$ where $\phi_m$ is a diameter of the first intake 1611 of the first passage 161 and $\phi_c$ is a diameter of the first outlet 1612 of the first passage 161; and the second outlet 1712 of the second passage 171 has a divergent angle k, and $5° \le k \le 12°$.

Figure 5:
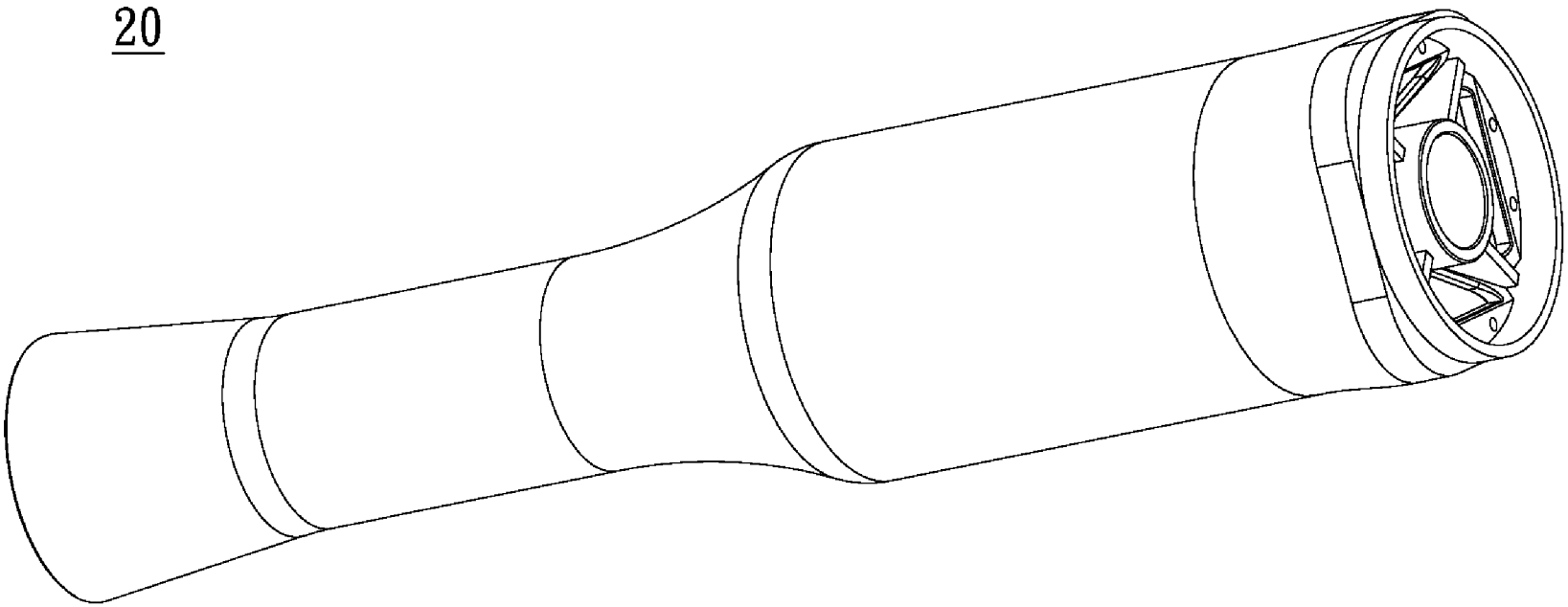
FIG. 5 is a perspective diagram of a nozzle device in accordance with a second embodiment of the invention.
Figure 6:
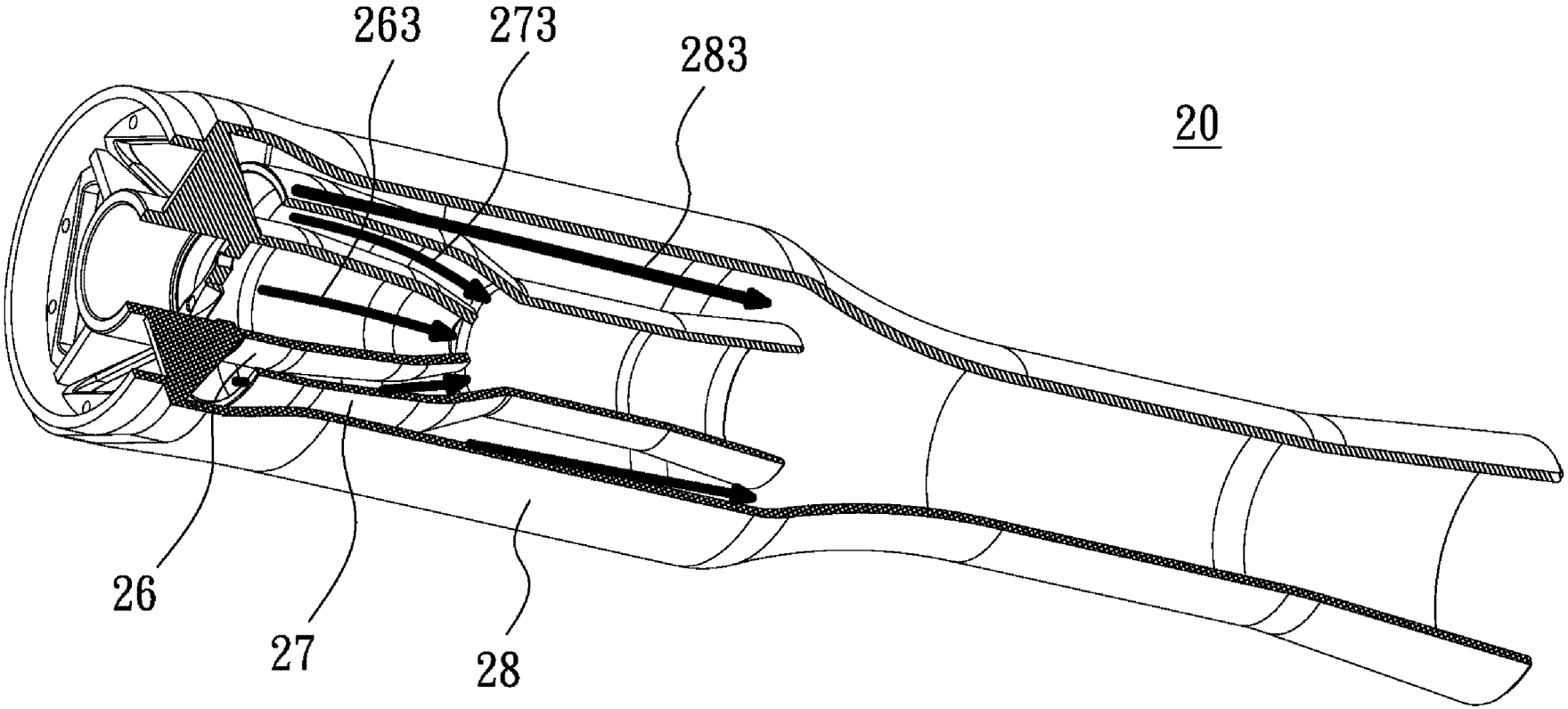
FIG. 6 depicts the nozzle device of FIG. 5, with a part thereof removed to show the internal structure.
Figure 7:
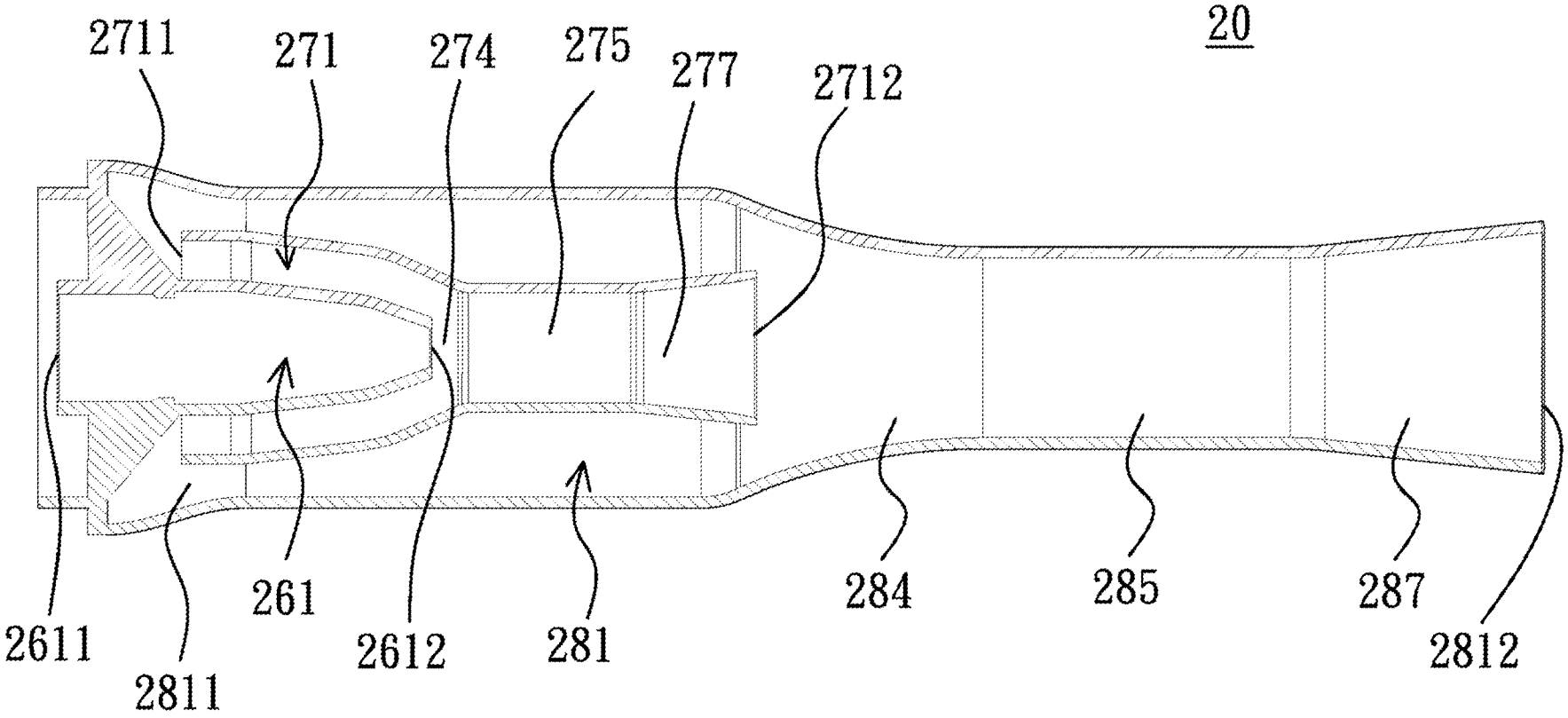
FIG. 7 is a sectional diagram of the nozzle device in accordance with the second embodiment of the invention.

Referring to FIGS. 5, 6 and 7, a nozzle device 20 in accordance with a second embodiment of the invention includes a first tubular body 26, a second tubular body 27, and a third tubular body 28. The first tubular body 26 is disposed in the second tubular body 27, and the second tubular body 27 is disposed in the third tubular body 28. Further referring to FIG. 7, the first tubular body 26 defines a first passage 261 having a first intake 2611 and a first outlet 2612. The second tubular body 27 defines a second passage 271 having a second intake 2711 and a second outlet 2712. The third tubular body 28 defines a third passage 281 having a third intake 2811 and a third outlet 2812. Entry of outside air into the first intake 2611, the second intake 2711, and the third intake 2811 are respectively controlled by an inflation valve clapper, a first ambient valve clapper, and a second ambient valve clapper (not shown).

In operation, outside air is pumped into the first passage 261 through the first intake 2611 to form a first fluid flow 263. It is noted that the cross-sectional area of the first passage 261 is gradually reduced so that the first outlet 2612 has a smaller cross-sectional area than the first intake 2611. This arrangement is to increase a velocity of the first fluid flow 263 in the first passage 261 and form a first negative pressure zone 274 next to the first outlet 2612. When a first pressure of the first negative pressure zone 274 is reduced to a first predetermined value, the first ambient valve clapper (not shown) is opened via a pressure difference between the outside atmosphere and the first negative pressure zone 274, allowing outside air to flow into the second passage 271 through the second intake 2711 and forming a second fluid flow 273. The second passage 271 has a mixing zone 275 next to the first negative pressure zone 274, and the first fluid flow 263 exiting from the first passage 261 is mixed with the second fluid flow 273 in the mixing zone 275. The second passage 271 further has a diffusing zone 277 next to the mixing zone 275. In this embodiment, the diffusing zone 277 is tapered with increasing cross-sectional area from the mixing zone 275 to the second outlet 2712 so that the mixed first fluid flow 263 and second fluid flow 273 can spread in the diffusing zone 277 and smoothly exit from the second outlet 2712. Similarly, a second negative pressure zone 284 is formed outside the second passage 271 and next to the second outlet 2712. When a second pressure of the second negative pressure zone 284 is reduced to a second predetermined value, the second ambient valve clapper (not shown) is opened via a pressure difference between the outside atmosphere and the second negative pressure zone 284, allowing outside air to flow into the third passage 281 through the third intake 2811 and forming a third fluid flow 283. The third passage 281 has a mixing zone 285 next to the second negative pressure zone 284, and the first fluid flow 263 and the second fluid flow 273 exiting from the second passage 271 are mixed with the third fluid flow 283 in the mixing zone 285. The third passage 281 further has a diffusing zone 287 next to the mixing zone 285. The diffusing zone 287 is tapered with increasing cross-sectional area from the mixing zone 285 to the third outlet 2812 so that the mixed first fluid flow 263, second fluid flow 273, and third fluid flow 283 can spread in the diffusing zone 287 and smoothly enter an inflatable product.

It is noted that the first outlet 2612 is a converging outlet with gradually reducing cross-sectional area while the second outlet 2712 and the third outlet 2812 are diverging outlets with gradually increasing cross-sectional area.

In this embodiment, a third passage 281 is further provided to introduce air into an inflatable product. Therefore, the inflation by using the nozzle device of the second embodiment can be faster and more efficient than that of the first embodiment.

Figure 8:
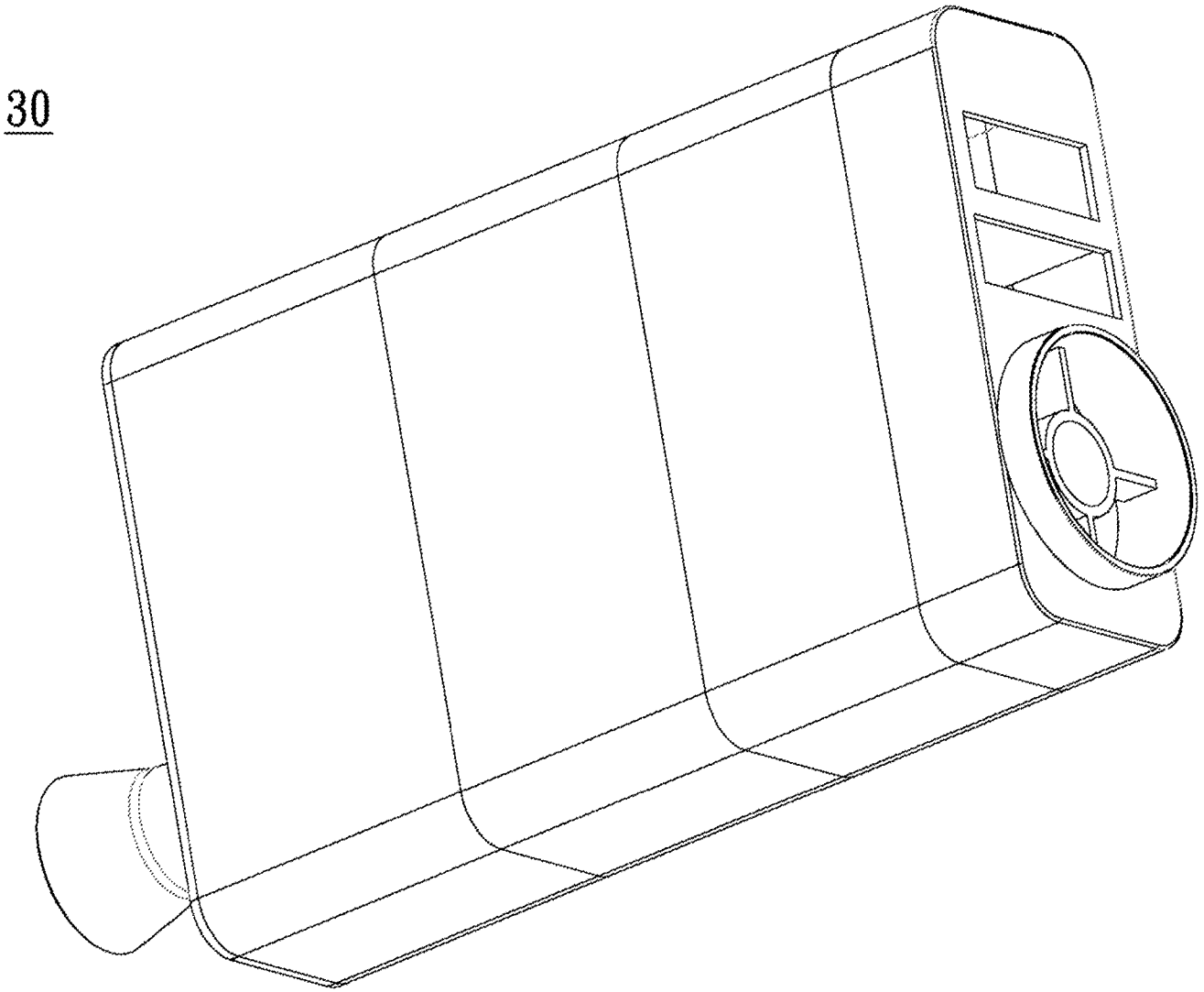
FIG. 8 is a perspective diagram of a nozzle device in accordance with a third embodiment of the invention.
Figure 9:
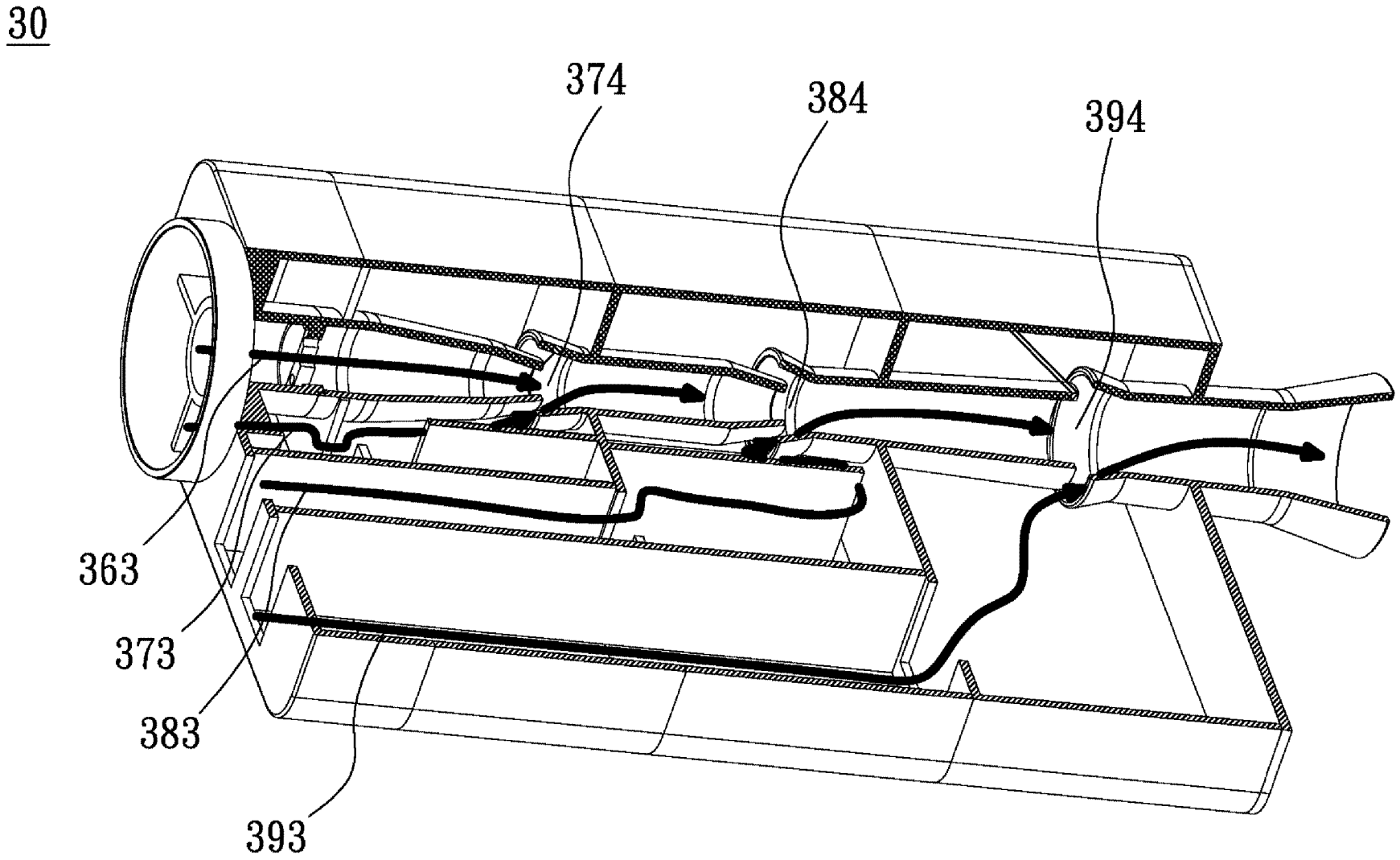
FIG. 9 depicts the nozzle device of FIG. 8, with a part thereof removed to show the internal structure.
Figure 10:
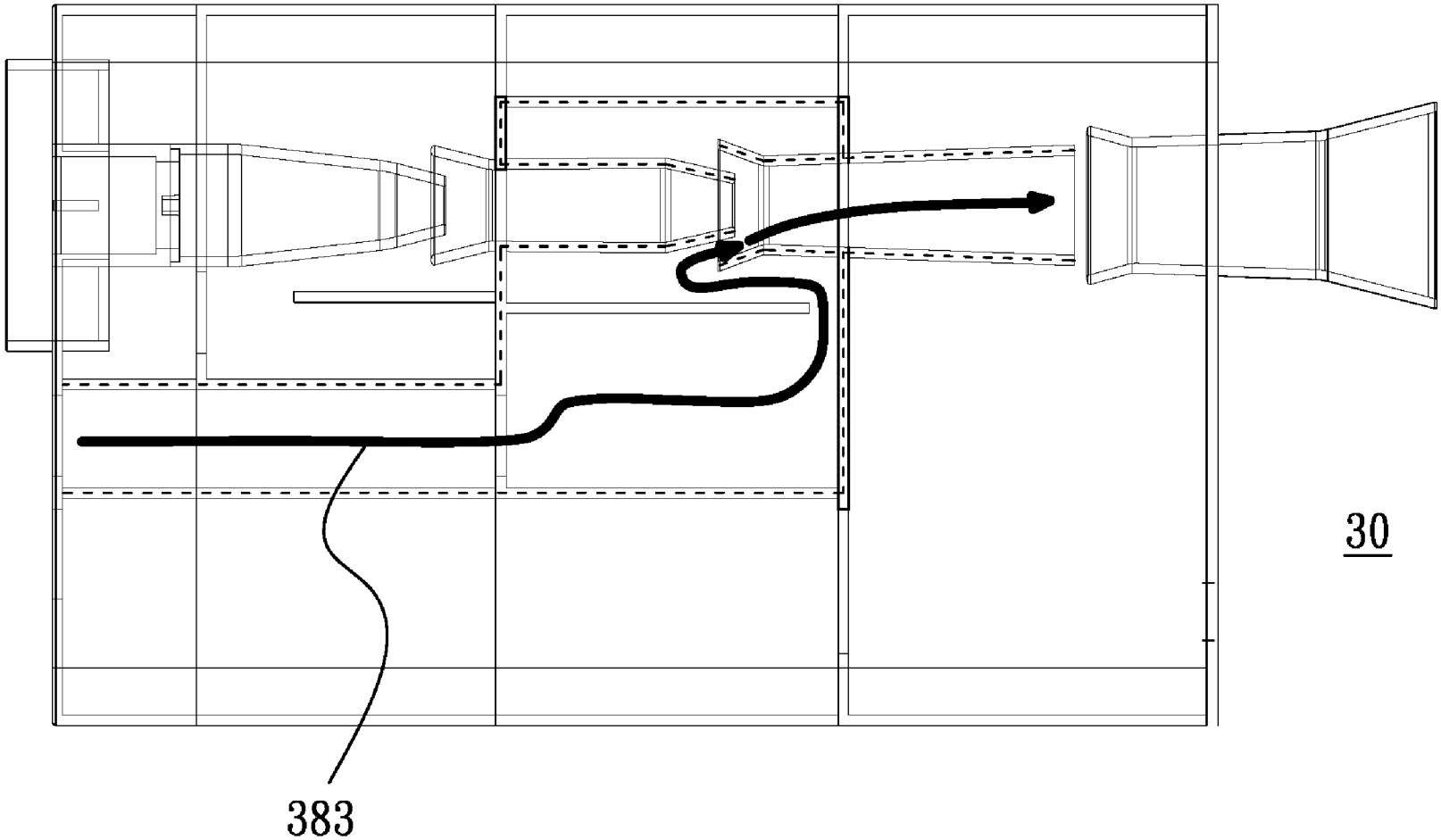
FIG. 10 depicts the internal structure of the nozzle device in accordance with the third embodiment of the invention, with the outline of a third passage particularly marked by broken lines.

Referring to FIGS. 8, 9 and 10, a nozzle device 30 in accordance with a third embodiment of the invention includes a first passage, a second passage, a third passage, and a fourth passage. For easy understanding, the outline of the third passage is particularly marked by broken lines in FIG. 10. It is noted that the third passage is constituted by a tube and partition boards. Although the outlines of the first, second, and fourth passages are not marked in FIG. 10, these passages can be still recognized by reading the subsequent description. Similar to those of the previous embodiments, an inflation valve clapper, a first ambient valve clapper, a second ambient valve clapper, and a third ambient valve clapper (not shown) are respectively provided to control entry of outside air into the first passage, the second passage, the third passage, and the fourth passage. In operation, outside air is pumped into the first passage to form a first fluid flow 363. A first negative pressure zone 374 is formed next to the first outlet of the first passage. When a first pressure of the first negative pressure zone 374 is reduced to a first predetermined value, the first ambient valve clapper (not shown) is opened via a pressure difference between the outside atmosphere and the first negative pressure zone 374 allowing outside air to flow into the second passage and forming a second fluid flow 373. A second negative pressure zone 384 is formed next to the second outlet of the second passage. When a second pressure of the second negative pressure zone 384 is reduced to a second predetermined value, the second ambient valve clapper (not shown) is opened via a pressure difference between the outside atmosphere and the second negative pressure zone 384 allowing outside air to flow into the third passage and forming a third fluid flow 383. A third negative pressure zone 394 is formed next to the third outlet of the third passage. When a third pressure of the third negative pressure zone 394 is reduced to a third predetermined value, the third ambient valve clapper (not shown) is opened via a pressure difference between the outside atmosphere and the third negative pressure zone 394 allowing outside air to flow into the fourth passage. All the fluid flows (the first, second, third, and fourth fluid flows) eventually enter an inflatable product through the fourth passage.

In this embodiment, the first outlet and the second outlet are converging outlets with gradually reducing cross-sectional area, while the third outlet and the fourth outlet are diverging outlets with gradually increasing cross-sectional area.

In this embodiment, a fourth passage is further provided to introduce air into an inflatable product. Therefore, the inflation by using the nozzle device of the third embodiment is faster and more efficient than that of the second embodiment.

It is to be understood that the nozzle device of the invention is not limited to air inflation. To the contrary, any fluid can be more efficiently pumped into a chamber or a storage space through the nozzle device of the invention.

What is claimed is:

1. An apparatus comprising:

an inflatable product; and a nozzle device configured to introduce fluid outside the inflatable product into the inflatable product and comprising a first passage, a second passage and a first ambient valve clapper;

wherein the first passage comprises a first intake and a first outlet, and an end portion of the first passage is tapered to the first outlet;

wherein the second passage comprises a second intake and a second outlet, and wherein the second passage comprises a first portion having a cross-sectional area that is decreasing intersecting a second portion having a cross-sectional area that is not decreasing;

wherein the first outlet of the first passage is located inside the first portion of the second passage before the intersection of the first portion and the second portion;

wherein the first ambient valve clapper is configured to control entry of the fluid into the second passage through the second intake;

arranged such that the fluid outside the inflatable product flows through the first intake into the first passage to form a first fluid flow when the fluid is pumped, a first negative pressure zone is formed outside the first passage and next to the first outlet, and the first ambient valve clapper is opened via a pressure difference between the first negative pressure zone and a surrounding of the inflatable product, allowing the fluid outside the inflatable product to further flow into the second passage to form a second fluid flow; and wherein the first portion of the second passage is tapered from the first outlet of the first passage to a location where the first portion intersects with the second portion.

2. The apparatus as claimed in claim 1, wherein the first passage is disposed in the second passage.

3. The apparatus as claimed in claim 1, wherein the first outlet has a smaller cross-sectional area than the first intake to increase a velocity of the first fluid flow at the first outlet and form the first negative pressure zone.

4. The apparatus as claimed in claim 1, wherein the second passage further comprises a mixing zone corresponding to the second portion next to the first negative pressure zone, and the first fluid flow exiting from the first passage is mixed with the second fluid flow in the mixing zone.

5. The apparatus as claimed in claim 4, wherein the nozzle device satisfies:

$$\frac{S_e}{S_c} = \left(\frac{\phi_e}{\phi_c}\right)^2 = \left[\frac{1+U_0}{\sqrt{\frac{\tau^2}{2-\tau^2}}} \cdot \sqrt{\frac{\Delta q}{\Delta p}}\right]$$

where $S_e$ is a cross-sectional area of the mixing zone, $S_c$ is a cross-sectional area of the first outlet, $\phi_e$ is a diameter of the mixing zone, $\phi_c$ is a diameter of the first outlet, $U_0$ is a volume injection coefficient, $\tau$ is a coefficient of diffusion velocity, $\Delta q$ is a difference between a pumping pressure for the fluid to enter the first passage and a pressure in the first negative zone, and $\Delta p$ is a pressure difference between the surrounding of the nozzle device and the first negative pressure zone.

6. The apparatus as claimed in claim 5, wherein $0.5<\tau<1$.

7. The apparatus as claimed in claim 4, wherein the mixing zone has a length b, and $6\phi_c \le b \le 10\phi_c$ where $\phi_c$ is a diameter of the first outlet of the first passage.

8. The apparatus as claimed in claim 4, wherein the second passage further comprises a diffusing zone to the mixing zone, and the diffusing zone has a greater cross-sectional area than the mixing zone so that the mixed first fluid flow and second fluid flow spread in the diffusing zone.

9. The apparatus as claimed in claim 8, wherein the diffusing zone is tapered.

10. The apparatus as claimed in claim 6, wherein the diffusing zone has a length h, and $2(\phi_m-\phi_c) \le h \le 4(\phi_m-\phi_c)$ where $\phi_m$ is a diameter of the first intake of the first passage and $\phi_c$ is a diameter of the first outlet of the first passage.

11. The apparatus as claimed in claim 1, wherein the second outlet of the second passage has a divergent angle k, and $5° \le k \le 12°$.

12. The nozzle device as claimed in claim 1, further comprising:

a third passage comprising a third intake and a third outlet;

a second ambient valve clapper configured to control entry of the fluid into the third passage through the third intake to form a third fluid flow;

wherein a second negative pressure zone is formed outside the second passage and next to the second outlet, and the second ambient valve clapper is opened via a pressure difference between the second negative pressure zone and the surrounding of the nozzle device, allowing the fluid to further flow into the third passage to form the third fluid flow.

13. The nozzle device as claimed in claim 12, wherein the first passage is disposed in the second passage, and the second passage is disposed in the third passage.

14. The nozzle device as claimed in claim 12, wherein the third passage further comprises a mixing zone next to the second negative pressure zone, and the first and second fluid flows exiting from the second passage are mixed with the third fluid flow in the mixing zone.

15. The nozzle device as claimed in claim 14, wherein the third passage further comprises a diffusing zone next to the mixing zone, and the diffusing zone has a greater cross-sectional area than the mixing zone so that the mixed first, second, and third fluid flows spread in the diffusing zone.

16. The nozzle device as claimed in claim 12, wherein the first outlet is a converging outlet, while the second outlet and the third outlet are diverging outlets.

17. The nozzle device as claimed in claim 12, further comprising:

a fourth passage comprising a fourth intake and a fourth outlet;

a third ambient valve clapper configured to control entry of the fluid into the fourth passage through the fourth intake to form a fourth fluid flow;

wherein a third negative pressure zone is formed outside the third passage and next to the third outlet, and the third ambient valve clapper is opened via a pressure difference between the third negative pressure zone and the surrounding of the nozzle device, allowing the fluid to further flow into the fourth passage to form the fourth fluid flow.

18. The nozzle device as claimed in claim 17, wherein the first outlet and the second outlet are converging outlets, while the third outlet and the fourth outlet are diverging outlets.

* * * * *